United States Patent [19]

Reeves

[11] Patent Number: 4,509,409

[45] Date of Patent: Apr. 9, 1985

[54] PUMP ARRANGEMENT FOR A LINEAR FLUID OPERATED DEVICE

[75] Inventor: Jerry L. Reeves, Dallas, Oreg.

[73] Assignee: Towmotor Corporation, Mentor, Ohio

[21] Appl. No.: 464,243

[22] Filed: Feb. 7, 1983

[51] Int. Cl.[3] ..... F15B 21/04

[52] U.S. Cl. ..... 92/80; 92/82; 92/86; 92/181 P

[58] Field of Search ..... 91/422, 468; 92/80, 92/82, 86, 181 R, 181 P; 417/245, 259, 260, 386, 387, 388

[56] References Cited

U.S. PATENT DOCUMENTS

| | | | |
|---|---|---|---|
| 3,293,994 | 12/1966 | Napolitano | 92/82 |
| 3,311,026 | 3/1967 | Crisp | 91/401 |
| 3,578,882 | 5/1971 | Janssen | 417/245 |
| 3,991,832 | 11/1976 | Cooper | 91/401 |
| 4,023,363 | 5/1977 | Liebert | 91/401 |

FOREIGN PATENT DOCUMENTS 2754016 2/1981 Fed. Rep. of Germany .

*Primary Examiner*—Richard E. Schafer
*Assistant Examiner*—Richard Klein
*Attorney, Agent, or Firm*—Alan J. Hickman

[57] ABSTRACT

This invention relates to a pump arrangement (54) for use in a linear fluid operated device having a reciprocating piston (14) separating a first active fluid chamber (30) and a second chamber (32) which eliminates the problem associated with fluid leakage buildup developing in the second chamber. The pump arrangement (54) is connected to the reciprocating piston (14) and pumps leakage fluid present in the second chamber (32) from the second chamber (32) and into the first chamber (30) in response to a force of a preselected minimum magnitude being applied to the pump arrangement (54). Thus, the problems of inefficient linear fluid operated device operation, reduced piston stroke length, external fluid leakage, and erratic piston travel speed are eliminated. The pump arrangement (54) is particularly suited for use in a single acting linear hydraulic jack (12) such as used on a material handling vehicle.

2 Claims, 3 Drawing Figures

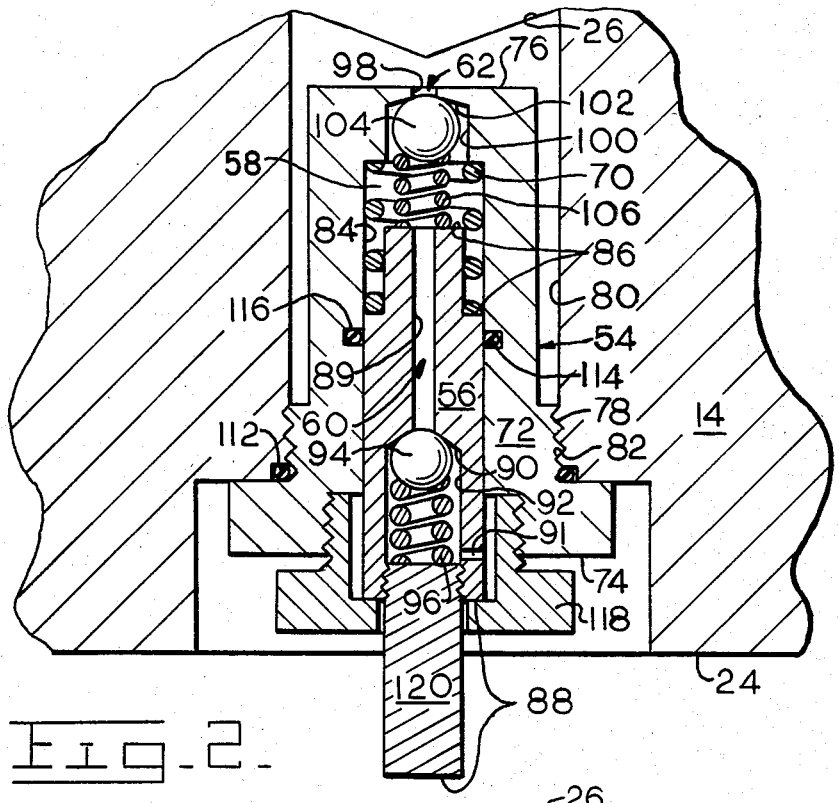
Fig. 2.
Fig. 3.
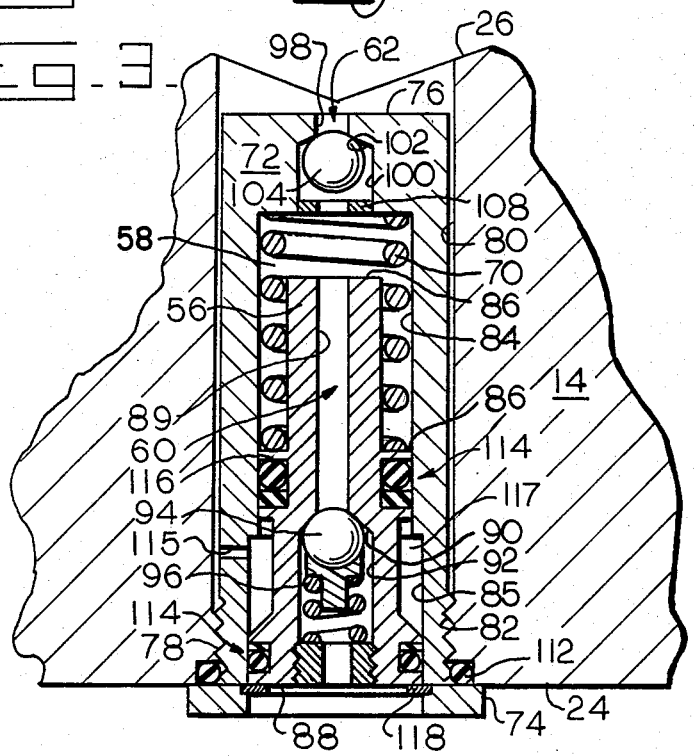

PUMP ARRANGEMENT FOR A LINEAR FLUID OPERATED DEVICE

DESCRIPTION

1. Technical Field

This invention relates to a pump arrangement for a linear fluid operated device and more particularly to a purge pump arrangement mountable on a reciprocating piston of a fluid operated jack and operative for pumping leakage fluid from a passive chamber on one side of the piston to an active fluid chamber on the other side of the piston.

2. Background Art

Linear fluid operated devices, such as single acting hydraulic jacks, accumulators and the like have a cylinder housing and a reciprocating piston assembly mounted therein for reciprocal movement along and relative to the housing. The reciprocating piston assembly normally has a fluid seal connected thereto which is engageable with the housing to prevent the passing of fluid from a first active fluid chamber on one side of the piston to a second passive chamber on the other side of the piston. However, a seal has not been found which has zero leakage and therefore fluid is ultimately passed across the seal to the passive chamber. This is particularly true in single acting hydraulic devices when the pressure differential across the piston is substantial.

It is recognized that fluid leakage trapped in the passive chamber of the device will adversely affect the operation of the hydraulic jack by reducing the stroke length of the piston and eventually eliminate movement altogether if not removed. Thus, several approaches have been tried to remove this leakage fluid from the passive chamber.

One attempt to solving this problem requires a drain line connecting the passive chamber to a reservoir. This solution, although simple, has deficiencies. Since the drain line must be connected to the passive chamber at the extreme upper end thereof the fluid leakage will be purged only at the top of stroke of the piston. In application where the piston infrequently moves to the top of stroke, a large amount of fluid build up will be carried by the piston, on the passive chamber side and therefore reduces the efficiency of the device. Usually the drain line is external to the jack and traverses a substantial distance between the reservoir and the jack. In typical applications of use, such as on a lift mast of a fork lift, the external line interferes with operator visibility, is subject to damage, is prone to leaking, and relatively expensive.

Another attempt to solving the leakage problem involves a technique for returning leakage fluid to the active fluid chamber. A passage is provided in the piston which interconnects the active and passive chambers, and a check valve is disposed in the passage for blocking fluid flow from the active to the passive chambers. When the leakage fluid in the passive chamber reaches a substantial volume, reciprocating piston movement toward top of stroke will try and compress the leakage fluid which will force the fluid past the check valve. This technique requires a piston rod be connected to the reciprocating piston to establish a differential effective area on each side of the piston so that the pressure on the rod side (passive chamber side) is greater than the pressure on the head side (active chamber side). Since this rod must extend from the cylinder, a rod seal is required. Therefore, this technique is only applicable for use in jacks and not in accumulators. In typical jack applications the piston infrequently moves to the top of stroke, therefore the volume of leakage fluid buildup will be substantial and a greater fluid pressure will be required to move the piston toward the passive chamber due to the weight of the leakage fluid. Further, since the leakage fluid is forced across the passage in the piston in response to fluid pressure in the active chamber acting on the piston, the efficiency of the jack is further reduced. Since the size of the passage is limited in cross sectional area by the size of the piston the passage will act as an orifice and pass fluid flow at a slower rate than desired. Thus, speed of travel of the piston will abruptly change during purging of leakage fluid.

The present invention is directed to overcoming one or more of the problems as set forth above.

DISCLOSURE OF THE INVENTION

In one aspect of the present invention, a pump arrangement for use on a linear fluid operated device having first and second chambers separated by a reciprocating piston is provided. The pump arrangement is mountable on the reciprocating piston and has a pump piston, a pump chamber, a first passage connecting the first chamber to the pump chamber, and a second passage connecting the second chamber to the pump chamber. A first check valve associated with the first passage prevents fluid flow in the first passage from passing from the first chamber to the pump chamber, a second check valve associated with the second passage prevents fluid flow in the second passage from passing from the pump chamber to the second chamber, and the pump piston being movable toward the pump chamber in response to a preselected minimum force being applied to the pump piston to force fluid from the pump chamber through the first passage and into the first chamber.

In another aspect of the present invention, a single acting linear hydraulic jack having first and second chambers separated by a reciprocating piston is provided. A pump arrangement is mounted on the reciprocating piston and actuatable in response to a force of a preselected minimum magnitude being applied thereto to force leakage fluid from the second chamnber to the first chamber.

Therefore, the pumping arrangement alleviates the problems previously discussed by internally transferring fluid between the second and first chambers, providing a pumping arrangement which does not utilize the reciprocating piston as the leakage fluid pumping member and does not require a preselected minimum volume or level of leakage fluid in the second chamber in order to transfer fluid therefrom. Also the pumping arrangement is applicable for use in either a single acting jack or an accumulator and does not require the second chamber to be sealed.

BRIEF DESCRIPTION OF THE DRAWINGS

FIG. 2 is a diagrammatic cross sectional view of a mechanically actuatable embodiment of the pump arrangement of FIG. 1; and FIG. 3 is a diagrammatic cross sectional view of a fluid pressure actuatable embodiment of the pump arrangement of FIG. 1.

BEST MODE FOR CARRYING OUT THE INVENTION

Figure 1:
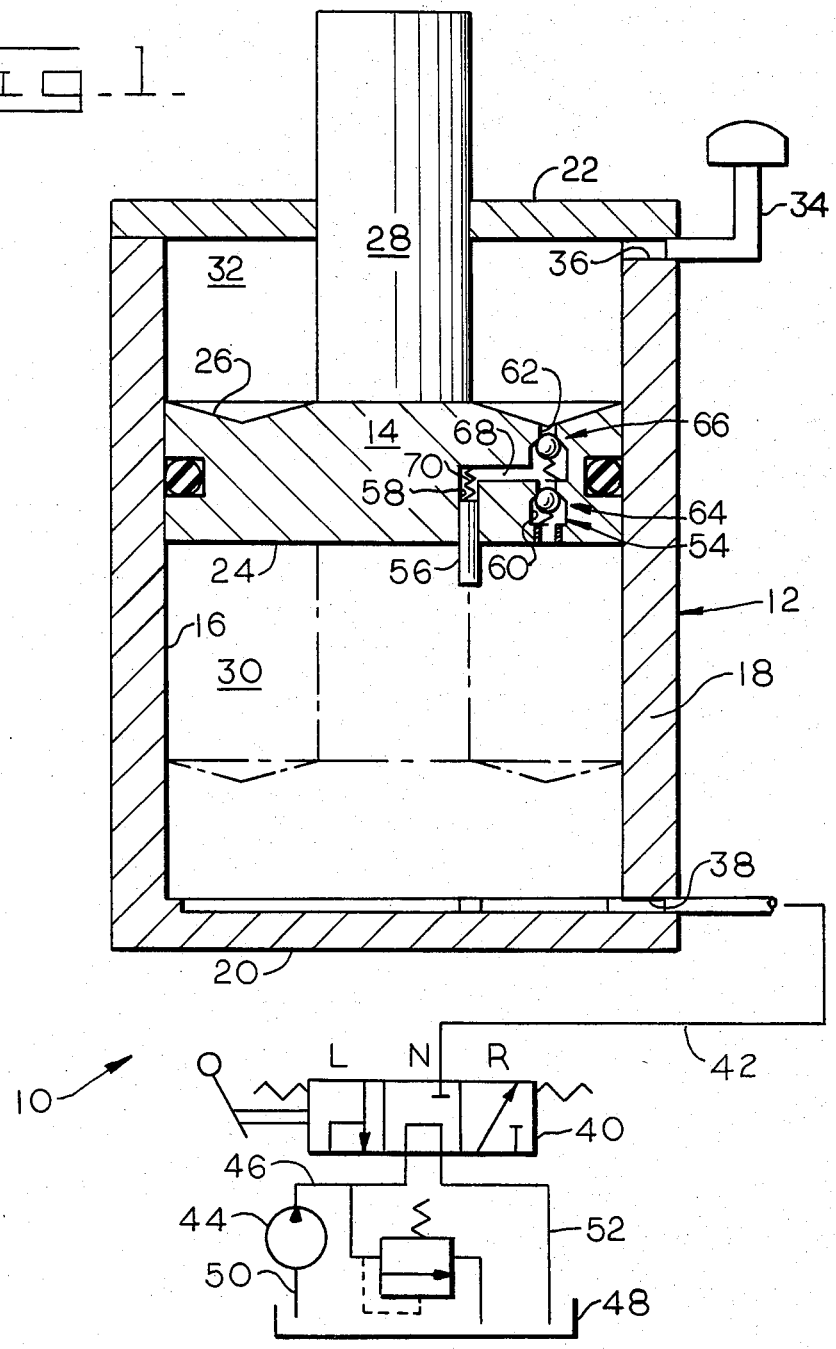
FIG. 1 is a diagrammatic representation of an embodiment of the present invention schematically showing an implement system and a pump arrangement in use in a vented single acting fluid operated jack.

Referring to the drawings and particularly the drawing of FIG. 1, a fluid operated system 10 of the implement type is shown. The system 10 includes a linear single acting fluid operated jack 12 having a reciprocating piston 14 slidably sealingly disposed in a bore 16 in a cylinder housing 18 and movable along said bore 16 between first 20 and second 22 ends of the housing 18. The reciprocating piston 14 has first 24 and second 26 sides and a cylindrical piston rod 28 connected to the second side 26 and extending therefrom past the second end 22 of the housing 18. The second side 26 preferably has an annular groove thereon for collecting and directing leakage fluid. The first side 24 of the reciprocating piston 14, the bore 16 and the first end 20 of the housing 18 define a first chamber 30 and the second side 26 of the reciprocating piston 14, the bore 16 and the second end 22 of the housing 18 define a second chamber 32. A breather 34 is connected to a passage 36 in the housing 18 which opens into the second chamber 32 at a location closely adjacent the second end 22. The breather 34 vents the second chamber 32 to atmosphere and prevents contaminants from entering the second chamber 32. The breather is of a well known construction and will not be discussed in any greater detail.

A fluid passing port 38 is disposed in the cylinder housing 18 at a location adjacent the first end 20 thereof and opens in the first chamber 30. A fluid directing control valve 40 which is preferably a three-position three-way manually actuated linear spool valve having a neutral "N", raise "R" and lower "L" position is connected to the fluid passing port by a conduit 42. A source of pressurized fluid flow 44, such as a source pump, is connected to the control valve 40 via conduit 46. The source pump 44 draws fluid flow from a reservoir 48 through a conduit 50 and passes the fluid flow through conduit 46 to the control valve 40. A drain line 52 connects the control valve 40 to the reservoir 48 and passes fluid flow therebetween.

A pump arrangement 54 is provided in the fluid operated system 10 for pumping leakage fluid from the second chamber 32 to the first chamber 30. The pump arrangement 54 has a pump piston 56, a pump chamber 58, first and second passages 60 and 62, and first and second check valves 64 and 66 all connected to move with reciprocating piston 14. The first passage 60 connects the pump chamber 58 to the first chamber 30 for passing fluid flow therebetween and the second passage 62 connects the pump chamber 58 to the second chamber 32 for passing fluid flow therebetween. The first check valve 64 is disposed in the first passage 60 and is operative to pass fluid flow from the pump chamber 58 to the first chamber 30 and prevents the passing of fluid flow from the first chamber 30 to the pump chamber 58. Also, the first check valve 64 prevents fluid flow from passing from the first chamber 30 to the second chamber 32 via the first and second passages 60 and 62. The second check valve 66 is disposed in the second passage 62 and is operative to pass fluid flow from the second chamber 32 to the pump chamber 58 and prevents the passing of fluid flow from the pump chamber 58 to the second chamber 32. The second check valve 66 also prevents fluid flow from passing from the first chamber 30 to the second chamber 32 via the first and second passages 60 and 62. It is to be noted that the first and second passages 60 and 62 each share a common branch passage 68 connecting the passages 60 and 62 to the pump chamber. This, however, is a matter of choice ane may be replaced by two separate branch passages.

The pump piston 56 is slidably sealingly disposed in the pump chamber 58 and movable in a first direction toward the pump chamber 58 and relative thereto to force fluid flow from the pump chamber 58 through the first passage 60 and into the first chamber in response to a preselected minimum force being applied to the pump piston 56 in the first direction of pump piston movement. The pump piston is also movable in a second direction, directly opposite the first direction, in response to the force being less than the preselected minimum and under the bias of spring 70. Fluid is drawn from the second chamber 32 to the pump chamber 58 in response to and as a result of movement of the pump piston in the second direction. Thus, the pump arrangement 54 positively removes leakage fluid from the second chamber 32 and forces the fluid into the first chamber 30.

The pump arrangement 54 of FIG. 1 is illustrated in greater detail in the embodiments shown in FIGS. 2 and 3. Due to similarities in construction of the embodiments of the pump arrangement 54 shown in FIGS. 2 and 3 all discussion, unless otherwise specified, will refer to both FIGS. 2 and 3. Common reference numerals will be used where applicable, different parts will be numbered separately, and functional differences will be discussed. Referring to FIGS. 2 and 3, the pump arrangement 54 includes a substantially cylindrical pump body 72 having a first end 74, a second end 76, and a threaded end portion 78. The pump body 72 is disposed in a receiving aperture 80 in reciprocating piston 14 with the threaded end portion 78 screwthreadably engageable with a threaded end portion 82 of the aperture 80. The aperture 80 opens at the first 24 and second 26 sides of the reciprocating piston into the first 30 and second 32 chambers, respectively, and the first 74 and second 76 ends face and are exposed to the first 30 and second 32 chambers, respectively. The pump body 72 has an elongated cylindrical bore 84 disposed therein and opening at the first end 74 of the pump body 72. In FIG. 3, the cylindrical bore has a step 85 adjacent the first end portion 74 of the body 72. This step defines a differential area with the pump piston 56. The pump piston 56 which is cylindrically shaped is slidably disposed in the bore 84 with a stepped pumping end 86 thereof facing toward the pump body second end 76 and a force responsive end 88 facing toward the opening of the first body end 74 and the first chamber 30. The bore 84, the second body end 76 and the piston pumping end 86 define the pump chamber 58.

The first passage 60 includes a first aperture 89 axially disposed in pump piston 56. The aperture 89 opens at the pumping end 86 of the piston into the pump chamber 58 and opens at a location adjacent the force responsive end 88 of the pump piston 56 into the first chamber 30. The first aperture 89 has a first increased diameter portion 92 located adjacent the force responsive end 88 of the pump piston 56. A first spherical ball check 94 is disposed in the first increased diameter portion 92 of the first aperture 89 and engageable with a first tapered seat surface 90 defined by the first aperture 89. A first light spring 96 which is also disposed in the first increased diameter portion 92 of the first aperture 89 biases the first spherical ball 94 into contact with the first seat 90. It is to be noted that the first passage 60, in FIG. 2 includes an aperture 91 radially disposed in the pump piston 56 which connects the aperture 89 to the first chamber 30.

The second passage 62 includes a second aperture 98 disposed in the second end 76 of the pump body 72. The second aperture 98 extends through the pump body 72 and opens into the pump chamber 58 and second chamber 32 to pass fluid flow therebetween. The second aperture 98 has a second increased diameter portion 100 and a second tapered seat surface 102. A second spherical ball check 104 is disposed in the second increased diameter portion 100 and biased into contact with the second tapered seat surface 102 via a second light spring 106. In the embodiment of FIG. 3, the second light spring 106 is replaced by a retainer 108 of a well known construction which retains the ball check 104 within the second increased diameter portion 100 of the second aperture 98.

Spring 70 is disposed in the pump chamber 58 and is engageable with the pump body 72 and the pumping end 86 of the pump piston 56. Spring 70 serves to bias the pump piston 56 in the second direction towards the first end 74 of the pump body 72 and to a location wherein the pump chamber 58 volume is at a maximum.

A static seal 112 of the O-ring type is disposed about the pump body 72 at a location adjacent the first end 74 thereof. This seal 112 is engageable with the reciprocating piston 14 to prevent fluid from passing thereby and between the first and second chambers 30 and 32. A dynamic seal 114 is also provided to prevent fluid from passing by the pump piston 56 between the pump chamber 58 and the first chamber 30. In FIG. 2, seal 114 is disposed in an annular groove 116 in the bore 84 of the pump body 72 and engageable with the cylindrically shaped pump piston 56. In FIG. 3, the seal is disposed in an annular groove 116 disposed about the pump portion 56 and engageable with the bore 84 of the pump body 72. It should be noted that one seal 114 is provided in the embodiment of FIG. 2 and two seals 114 are provided in the embodiment of FIG. 3. It should be noted that in FIG. 3 each seal 114 is selected separately and may be of a different construction and configuration from the other. A vent hole 115 is radially disposed in pump body 72 at the stepped portion 85 and opens at opposite ends thereof into cavity 117 and aperture 80 which is open to second chamber 32.

A stop 118 is provided adjacent the first end of the pump body 72 to retain the piston 56 in the bore 84. The stop 118 is configured in FIG. 2 as a nut, screwthreadably connected to the pump body, and in FIG. 3 as a snap ring disposed in a groove in the pump body 72.

In the mechanically actuated embodiment of the pump arrangement 54 shown in FIG. 2 the pump piston 56 includes a pump piston extension portion 120 at the force responsive end 88 of the pump piston 56 to further extend the force responsive end 88. The extension 120 extends past the end 74 of the pump body 72 and the end 88 thereof is contactably engageable with the first end 20 of the cylinder housing 18 when the reciprocating piston 14 is positioned adjacent the first end 20 and within a preselected range of distance therefrom. Movement of the reciprocating piston 14 toward the first end 20, when the end 88 and extension 120 is in contact therewith, will cause movement of the pump piston 56 into the chamber 58. Preferably, the pump piston 56 and the bore 84 are oriented normal to the first end 20 of the cylinder housing 18 and/or parallel to the bore 16 of the cylinder housing so that only linear forces are applied to the pump piston in the direction of movement of the pump piston along the bore 84.

The fluid pressure actuated embodiment of the pump arrangement 54 as shown in FIG. 3 responds to fluid pressure acting against the force responsive and 88 of the pump piston 56. When the pressure acting on the force responsive end is at or above a preselected minimum value, the piston will move in the first direction toward the pump body 72 second end 76 and when less than the preselected maximum the piston will move in the second direction toward the first end 74 of the pump body 72 until it contacts the stop 118.

Industrial Applicability

In operation and with reference to the drawings, the pump arrangement 54 is operative to scavenge leakage fluid from the second chamber 32 and to positively forceably deliver the leakage fluid under pressure to the first chamber 30. To actuate the pump arrangement 54 to forceably deliver leakage fluid, the pump piston 56 must be biased to move in the first direction toward the pump chamber 58 and relative to the reciprocating piston 14. This is achieved by either mechanically forcing the piston 56 to move toward the chamber 58 (FIG. 2) or pressurizing the fluid in first chamber 30 to a preselected minimum value at which the fluid pressure will overcome the bias of spring 70 and cause movement of the pump piston 56 toward and into pump chamber 58 (FIG. 3). This preselected minimum pressure is determined by the spring rates of springs 70 and 96, the effective area of ball check 94, and differential area between seals 114 (FIG. 3) defined by the pump piston 56 at the stepped portion 85 of the bore 84.

With reference to FIGS. 1 and 2, shifting of the control to position "L" will connect chamber 30 to the reservoir via conduits 42 and 52 and thereby release fluid flow, under the influence of gravity and/or a load applied to the piston rod 28 to the reservoir 48. The reciprocating piston 14 and the first side 24 thereof moves in response to the release of fluid from the first chamber 30 through a first distance toward the first end 20 of the jack 12 until contact is made between the force end 88 of the piston extension 120 of the pump piston 56 (FIG. 2) and the first end 20. Further movement of the reciprocating piston 14 toward the first end 20 and through a second distance will mechanically force movement of the pump piston 56 into and toward the pump chamber 58. Fluid in the pump chamber 58 will be forced by the pumping end 86 of the piston 56 from the pump chamber 58, into the first passage 60, past the first check valve 64 and into the first chamber 30. At the end of the reciprocating piston 14 stroke, the pumping action will cease since no additional reciprocating piston 14 movement and resulting pump piston movement is provided.

Leakage fluid in chamber 32 is drawn therefrom as a result of the scavenging or purging action of the pump arrangement 54. Due to the fit between the pump piston 56, the bore 84 and the seals 114 movement of the pump piston 56 in the second direction, out of the pump chamber 58 and toward the first end 74 of the pump body, will create a vacuum in the pump chamber 58 which will unseat check valve 66 and draw leakage fluid from the second chamber 32 into the pump chamber. This scavenging action takes place each time the pump piston 56 moves in the second direction under the bias of spring 70. To achieve this movement, the control valve 40 is shifted to the "R" position for delivering pressurized fluid flow from the source pump 44 to the first chamber 30 of the jack 12. As the reciprocating piston 14 moves away from the first end 20 and toward the second end 22, the pump piston 56 progressively moves relative to the reciprocating piston 14 in the second direction toward the first end 74 of the pump body 72. This movement continues to take place until the extension 120 is free from contact with the first end 20 of the jack housing 18. Once the pump piston 56 contacts the stop 118, the purging action is complete and the pump chamber 58 contains leakage fluid removed from the second chamber 32.

It should be noted that the first check valve 64 permits fluid to flow from the pump chamber 58 through the first passage 60 and into the first chamber 30 during the pumping stroke while the second check valve 66 blocks fluid from flowing from the pump chamber 58 through the second passage 62 and into the second chamber 32 during the pumping stroke. Conversely, during the purging stroke of the pump piston 56, the first check valve 64 blocks fluid from flowing from the first chamber 30 through the first passage 60 and into the pump chamber 58 while the second check valve 66 is open to pass fluid flow from the second chamber 32 through the second passage 62 and into the pump chamber 58.

The embodiment of the pump arrangement shown in FIG. 3 operates in the same manner as previously described, except that pump piston 56 is movable in response to fluid pressure in the first chamber 30. The differential area between the seals 114 defined by the stepped portion 85 of bore 84 and the piston 56 permits the fluid pumping action to take place. Whenever the fluid pressure in chamber 30 reaches a preselected minimum level, such as occurs when the jack is supporting a load, the force of the fluid acting on the first end 88 of the pump piston will overcome the force of spring 70 and move the pump piston 56 in the first direction. Conversely, whenever the fluid pressure in first chamber 30 falls below the preselected minimum pressure level, such as when no load is being carried by the jack or the reciprocating piston 14 is at rest against the first end 20 of housing 18, the pump piston will move under the bias of spring 70 in the second direction.

Thus, it can be seen that the pump arrangement 54 provides an apparatus which removes leakage fluid from the vented chamber 32 of the jack in a simple, efficient and positive manner and eliminates the heretofore mentioned problems associated with prior arrangement.

Other aspects, objects and advantages of the invention can be obtained from a study of the drawings, disclosure and appended claims.

I claim:

1. A linear fluid operated jack; comprising:

a housing having first and second end members and a bore extending between said end members;

a reciprocating piston having an aperture, and being slidably disposed in said bore and movable between said end members, said housing defining first and second chambers separated by said reciprocating piston, said second chamber being vented to the atmosphere;

a pumping assembly having a pump piston, a pump body having a pump chamber, and first and second fluid passages, said pumping assembly being disposed in said aperture, said first fluid passage connecting said first chamber to said pump chamber, and said second fluid passage connecting said second chamber to said pump chamber, said pump piston being slidably disposed in said pump chamber and movable in a first direction toward said pump chamber and in a second direction opposite said first direction, said pump piston being adapted to force fluid from said pump chamber in response to movement in said first direction and draw fluid into said pump chamber in response to movement in said second direction, said pump piston having a pumping end disposed in said pump chamber and a force responsive end exposed to said first chamber, said first passage having a first aperture and a first increased diameter portion and being disposed in said pump piston, said first increased diameter portion being open to said first chamber and said first aperture, and said first aperture being open to said pump chamber;

means for fastening said pump body to said reciprocating piston;

first means for passing fluid flow, in said first passage, from said pump chamber to said first chamber, and blocking fluid flow, in said first passage, from said first chamber to said pump chamber, said first means having a first seat surface disposed in the pump piston and connecting the first aperture to said first increased diameter portion, and a first check disposed in the first increased diameter portion of said first passage and engageable with the first seat surface;

second means for passing fluid flow, in said second passage, from said second chamber to said pump chamber, and blocking fluid flow, in said second passage from said pump chamber to said second chamber, said first and second means for passing being connected to said pumping assembly;

means for biasing said pump piston in said second direction; and means for applying a force to said pump piston and moving said pump piston in said first direction against said biasing means, said pump piston being movable in said first direction in response to said force being at or greater than a preselected minimum magnitude.

2. The linear fluid operated jack as set forth in claim 1 wherein the aperture of said reciprocating piston is open to said first and second chambers, and said pump body has a second end, said second passage being disposed in the second end of said pump body and having a second aperture and a second increased diameter portion, said second increased diameter portion being open to said pump chamber and said second aperture, and said second aperture being open to said second chamber, said second check valve means, includes;

a second seat surface disposed in the second increased diameter portion of said second passage and connecting the second aperture to said second increased diameter portion; and a second check disposed in the second increased diameter portion of said second passage and engageable with said second seat surface.

* * * * *